US010192692B2

(12) United States Patent
Reinhold et al.

(10) Patent No.: US 10,192,692 B2
(45) Date of Patent: Jan. 29, 2019

(54) EXPLOSION-PROOF CROSS-TYPE LIMIT SWITCH

(71) Applicant: Konecranes Global Corporation, Hyvinkää (FI)

(72) Inventors: Leja Reinhold, Künzelsau (DE); Volker Dietrich, Neuenstein (DE); Jonas Hartmann, Waldbuch (DE); Jürgen Kasper, Braunsbach (DE)

(73) Assignee: Konecranes Global Corporation, Hyvinkää (FI)

( * ) Notice: Subject to any disclaimer, the term of this patent is extended or adjusted under 35 U.S.C. 154(b) by 0 days.

(21) Appl. No.: 15/121,469

(22) PCT Filed: Feb. 25, 2015

(86) PCT No.: PCT/EP2015/053926
§ 371 (c)(1),
(2) Date: Aug. 25, 2016

(87) PCT Pub. No.: WO2015/128374
PCT Pub. Date: Sep. 3, 2015

(65) Prior Publication Data

US 2016/0358720 A1 Dec. 8, 2016

(30) Foreign Application Priority Data

Feb. 25, 2014 (DE) ..... 10 2014 102 403

(51) Int. Cl.
*H01H 3/40* (2006.01)
*H01H 3/16* (2006.01)
(Continued)

(52) U.S. Cl.
CPC ..... *H01H 3/40* (2013.01); *B66C 13/50* (2013.01); *B66D 1/56* (2013.01); *B66D 3/24* (2013.01); *H01H 3/16* (2013.01); *H01H 21/28* (2013.01)

(58) Field of Classification Search
CPC . H01H 3/40; H01H 3/16; H01H 21/28; B66D 3/24; B66D 1/56; B66C 13/50;
(Continued)

(56) References Cited

U.S. PATENT DOCUMENTS 6,576,851 B1 * 6/2003 Barlian ..... H01H 3/40 200/17 R
9,263,201 B2 * 2/2016 Pan ..... H01H 3/16

* cited by examiner

*Primary Examiner* — Edwin A. Leon
*Assistant Examiner* — Lheiren Mae A Caroc
(74) *Attorney, Agent, or Firm* — Leydig, Voit & Mayer, Ltd.

(57) ABSTRACT

A cross-type limit switch (10) with a housing (12) that contains a gear mechanism (24) that includes a cover plate (38), base plate (48), and intermediate plate (42). The intermediate plate (42) has first and second cutouts (44, 46) within which respective gearwheels (54, 58) are arranged. The first and second gear wheels (54, 58) have respective plugthrough openings (56, 60), and a shaft (20) coupled to an actuating lever (18) outside the housing is rotatably mounted in a first bearing arrangement (22) connected to the housing. The actuating lever shaft (20) extends through the first plugthrough opening (56) of the first gear wheel (54) for rotating and radially locating the first gear wheel (54). A rotary switch (30) arranged in the housing (12) has a switch shaft (138) rotatably mounted in a second bearing arrangement (106, 34) that extend through the second plugthrough opening (60) of the second gearwheel for rotating and radially locating the second gearwheel (58).

14 Claims, 6 Drawing Sheets

(51) Int. Cl.

| | |
|---|---|
| ***H01H 21/28*** | (2006.01) |
| ***B66C 13/50*** | (2006.01) |
| ***B66D 1/56*** | (2006.01) |
| ***B66D 3/24*** | (2006.01) |

(58) Field of Classification Search
CPC ..... F16H 37/12; F16H 48/14; F16H 57/0025; F16H 57/021; F16H 57/0493
USPC ..... 200/47, 501
See application file for complete search history.

EXPLOSION-PROOF CROSS-TYPE LIMIT SWITCH

FIELD OF THE INVENTION

The subject matter of the invention relates to an explosion-proof cross-type limit switch.

BACKGROUND OF THE INVENTION

Cross-type limit switches comprise a cruciform actuating lever that is actuated via stops arranged along an operating path. DE 1 112 182, for example, shows a limit switch comprising a multi-arm actuating lever that is connected to a lever shaft that, at the same time, acts as a switching shaft. Fastened to said shaft are switching cams that are brought into engagement with an appropriate number of switch contacts. Furthermore, arranged on this shaft is a detent disk that ensures that the limit switch engages in defined positions. Due to the lever shaft and the switching shaft being of the one-piece type, it is not possible to distinguish between a 0° and a 360° position of the actuating lever.

Other limit switches are shown in document WO 2012/065955 A1. Here the limit switch comprises a gear mechanism that is coupled with an input shaft, wherein the gear mechanism drive is coupled with a cam shaft. The limit switch comprises an additional angle-measuring device for measuring the angular position of the input shaft.

The aforementioned limit switches are suitable for use in non-explosive environments. In contrast, in explosive environments the components of a limit switch must comply with a certification guideline for explosion protection. Retrofitting a limit switch with an already certified housing with a gear mechanism may either be impossible because of space problems or necessitate a comprehensive new design.

DE 1 797 089 shows a gear drive comprising several pinions and wheels in a closed housing for running gears in precision engineering. Respectively one pinion and one wheel are coaxially combined in one unit, wherein the units of pinion and wheel are directly supported in cutouts of the housing, with the cutouts matching the form of the units. The gearwheels are supported without axles and shafts on their flat sides and tooth tips.

OBJECTS AND SUMMARY OF THE INVENTION

It is an object of the present invention is to provide a cross-type limit switch that can be derived from an already certified housing.

The cross-type limit switch according to the invention is explosion-proof. For example, the cross-type limit switch may comply with the explosion protection types "flameproof encapsulation" (ex-d) and/or "increased safety" (ex-e). The cross-type limit switch according to the invention includes a housing. Preferably, the housing is explosion-proof, in which case the housing complies with the explosion protection type "increased safety" (ex-e) and/or "flameproof encapsulation" (ex-d). The housing contains a gear mechanism that includes a gear mechanism cover plate, a gear mechanism base plate and at least one intermediate plate arranged between the gear mechanism cover plate and the gear mechanism base plate. The intermediate plate has at least one cutout in which a first gearwheel is arranged and a second cutout in which a second gearwheel is arranged. The first gearwheel has a first plug-through opening and the second gearwheel has a second plug-through opening. A shaft carries an actuating lever arranged outside the housing and is radially supported and axially rotatable in a first bearing arrangement connected to the housing. Preferably, the first bearing arrangement is a part that is separate from the gear mechanism. The shaft is arranged in the first plug-through opening and rotationally coupled to the first gearwheel (i.e. the shaft and the gearwheel are non-rotatably coupled one to another). The first gearwheel is radially and also axially supported via a shaft. Furthermore, a rotary switch is arranged in the housing, with the switch comprising a switch shaft that is rotatably supported in a second bearing arrangement and in the second plug-through opening. The switch shaft is rotationally coupled to the second gearwheel, supporting it in axial and radial directions.

As a result of the structural design of the gear mechanism consisting of plates, a stacked design of the gear mechanism is achieved, this being particularly space-saving and easy to manufacture. In addition, the first cutout can hold or position the first gearwheel and the second cutout can hold or position the second gearwheel during assembly to such an extent that no additional holders or positioning aids are necessary during assembly. However, the gear mechanism does not support the first gearwheel and the second gearwheel.

Preferably, the first gearwheel and/or the second gearwheel are arranged with play in the first and second cutouts. In that regard, this is to mean a radial play, wherein the radial direction refers to the direction of rotation of the shaft of the switch shaft. However, the term "play" does not refer to a bearing play but, rather, the term "play" refers to the radial distance or the mean radial distance of the gearwheel from the respective cutout. Preferably, the play is greater than the radial bearing play of the shaft and/or the switch shaft. In this manner, the first gearwheel and/or the second gearwheel preferably moves—without contacting the wheel surface with the cutout and, hence, in a frictionless manner. The torques necessary for actuating a mains-voltage-conducting of a control-voltage-conducting switch can be readily transmitted in a reliable and low-wear manner.

The play is preferably smaller than a bezel or rounding provided on the shaft end face, wherein the comparison relates to the radial extension of the bezel or rounding. In this manner, the positioning through the cutouts is accurate enough so that the shaft or switch shaft can be easily inserted into the first or second plug-through opening. The shaft and/or the switch shaft may have a central outside hexagonal section and have, on both ends of the shaft and/or the switch shaft, a cylindrical section each, such section also being described as a round section. Preferably, the round section is disposed to support the shaft and/or the switch shaft. A bezel may be provided at a transition from a cylindrical section to an outside hexagonal section.

The first cutout and/or the second cutout preferably have straight walls in passage direction, with such walls radially delimiting the first and the second cutout, respectively. The first and/or the second cutouts are preferably passage openings though the intermediate plate transversely with respect to the plane defining the intermediate plate. Preferably, each of the first and/or the second cutouts have walls extending parallel to the axis of rotation. That is particularly preferred if the walls extend parallel to the axis of rotation. For example, the cutouts may be produced by punching, water jet cutting or laser cutting. A more cost-effective flexible small-series manufacture is thereby possible.

The first and the second cutouts may be provided in an intermediate plate. Preferably, the first cutout and the second cutout come into lateral engagement with each other. The first cutout and/or the second cutout are preferably circular but they may also be polygonal or follow another regular or irregular form. In a preferred embodiment, the first cutout and the second cutout overlap and form a passage opening of a first circular part and a second circular part, wherein the first part has a smaller diameter than the second part.

Preferably, the first cutout encloses the first gearwheel and the second cutout encloses the second gearwheel. The term "comprise" is to mean that the respective cutout encloses the gearwheel by more than 180°. In a first embodiment in which the first cutout encloses the first gearwheel and the second cutout encloses the second gearwheel, with the cutouts being arranged in an intermediate plate, sections of the intermediate plate form projections or noses in the gearwheels between the cutouts. As a result of this, a respective cutout a gearwheel is held such that the gear mechanism can be easily assembled.

The gear mechanism cover plate, the gear mechanism base plate and/or the intermediate plate are preferably elements with one planar upper side and one planar underside. Such planar elements can be made of plate-shaped base material by straight cuts extending in the direction of the later passage opening. The gear mechanism cover plate, the gear mechanism base plate and/or the intermediate plate preferably have walls extending transversely with respect to the underside or upper side. Preferably, the walls are perpendicular to the upper side or underside. This allows the aforementioned efficient manufacturing processes.

In a preferred embodiment the first gearwheel and/or the second gearwheel has a planar upper side and a planar underside. The first gearwheel and/or the second gearwheel preferably have walls extending transversely with respect to the underside and/or the upper side. In this manner, the first gearwheel and/or the second gearwheel are particularly easy to manufacture.

In a preferred embodiment the first gearwheel meshes with the second gearwheel. In a particularly preferred embodiment the gear mechanism comprises a first gearwheel and exactly one second gearwheel. Preferably, the first gearwheel is smaller than the second gearwheel. In a preferred embodiment the conversion of the movement of the shaft into the movement of the switch shaft is accomplished with the aid of a gear reduction. In doing so, a rotary movement of the first gearwheel that is coupled with the actuating lever is converted into a rotary movement of the second gearwheel, with the latter wheel covering a smaller angle. The first gearwheel and the second gearwheel are preferably arranged in one plane. The first gearwheel and/or the second gearwheel have, particularly preferably, a single gearwheel plane, so that the gearwheel has teeth only on a circumference having one diameter. Such a gearwheel can be manufactured in a particularly simple manner, for example by vertical cuts transversely to a planar upper side or underside of a plate-shaped starting material.

In a particularly preferred embodiment the shaft is coupled with a detent arrangement. The detent arrangement comprises a detent arrangement base plate, a detent arrangement cover plate and at least one detent arrangement intermediate plate with a pocket. Arranged in the pocket is a star wheel, in which case the star wheel is arranged on the aforesaid shaft. On its circumferential surface the star wheel is in engagement with a spring catch that initially inhibits a rotation of the star wheel out of its rest position and then, after overcoming a switch point, promotes the continuous rotation into the next rest position. The low friction of the gear mechanism having the design specifically described herein makes it possible for the detent arrangement to specify—in a low-tolerance manner—the rest positions subject to the action of the spring catch. In doing so, a safe switching of the cross-type limit switch is ensured.

Like the gear mechanism, the detent arrangement is essentially a plate stack, as a result of which a simple, space-saving design and a simple manufacture are made possible. The gear mechanism and the detent arrangement may be stacked to form a package, wherein the gear mechanism cover plate is arranged under the detent arrangement base plate. As a result of the stacked design a particularly space-saving construction of the detent arrangement is accomplished.

Preferably, the star wheel is arranged with play in the pocket, said pocket being preferably a cutout in the detent arrangement intermediate plate. Preferably, this is a passage opening transverse with respect to the plane defining the detent arrangement intermediate plate. Preferably, the star wheel is arranged with play in the pocket, this meaning the radial distance or the mean radial distance of the star wheel in the detent arrangement intermediate plate with respect to the wall delimiting the pocket in radial direction. In this manner, the star wheel may remain centered during the assembly of the cam switch in any event in such a manner that the shaft can be plugged simply through the passage opening of the star wheel.

The first bearing arrangement has a side that faces the inside of the housing and has a side that faces the atmosphere outside the housing. The first bearing arrangement may have a flame-proof gap. The first bearing arrangement may have one or several sliding bearings or antifriction bearings. The first bearing arrangement preferably comprises a bearing bushing.

The switch shaft of the rotary switch is preferably a cam shaft that can be brought into engagement with a switch element array located in the housing. The switch elements may be explosion-proof units that, for example, may be configured so as to comply with the explosion protection type "increased safety" (ex-e). Each of the switch elements, for example, may also be configured so as to comply with the explosion protection type "flame-proof encapsulation" (ex-d) in combination with the protection type "increased safety" (ex-e).

The second bearing arrangement is preferably completely arranged within the housing. A part of the second bearing arrangement may consist, for example, of an intermediate plate of the gear mechanism or a detent arrangement intermediate plate. For example, the bearing bushing may be arranged in the intermediate plate and/or the detent arrangement intermediate plate.

Other objects and advantages of the invention will become apparent upon reading the following detailed description and upon reference to the drawings.

Figure 1:
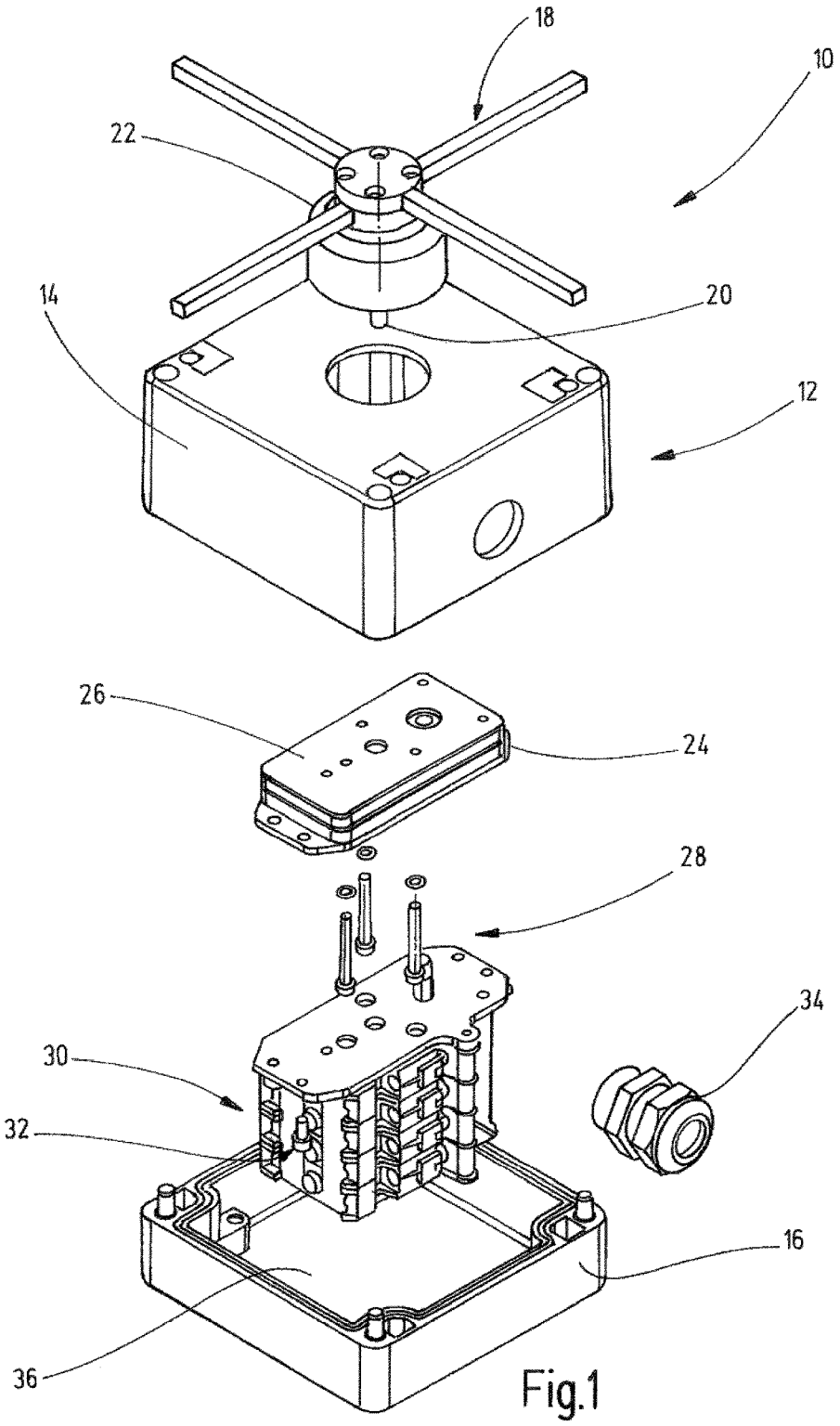
FIG. 1 is an exploded perspective of an illustrative cross-type limit switch in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Referring now more particularly to FIG. 1 of the drawings, there is shown an illustrative limit switch 10 in accordance with the invention which includes a housing 12 having a housing upper part 14 and a housing lower part 16. Outside the housing there is arranged a cruciform actuating lever 18 connected to a shaft 20. The shaft 20 is supported by a first bearing arrangement 22 that is also arranged outside the housing 12.

Inside the housing 12 there is an operating unit consisting of a gear mechanism 24 and a detent arrangement 26. The gear mechanism 24 and the detent arrangement 26 are composed of plate-shaped elements, as will be explained in greater detail in conjunction with FIGS. 2 and 3. In this embodiment, the bearing arrangement 22 is fixed against the housing upper part 14 by means of three screws 28 with the aid of the unit comprising the gear mechanism 24 and the detent arrangement 26.

Within the housing 12 below the gear mechanism 24 there is arranged a switch element assembly 30. The switch element assembly 30 also is fastened by means of screws 32 to the gear mechanism 24.

Located inside the housing 12 there is a passage 34 for electrical conductors (not illustrated) that are electrically connected to the switch elements of the switch element assembly 30, as will be understood by a person skilled in the art.

The housing 12 may be configured to comply with the explosion protection types "flame-proof encapsulation" (ex-d) and/or "increased safety" (ex-e). In particular, referring to the flame-proof encapsulation, all joints may be flameproof, wherein the joints might represent a potential connection between the inside 36 of the housing and the atmosphere.

Figure 2:
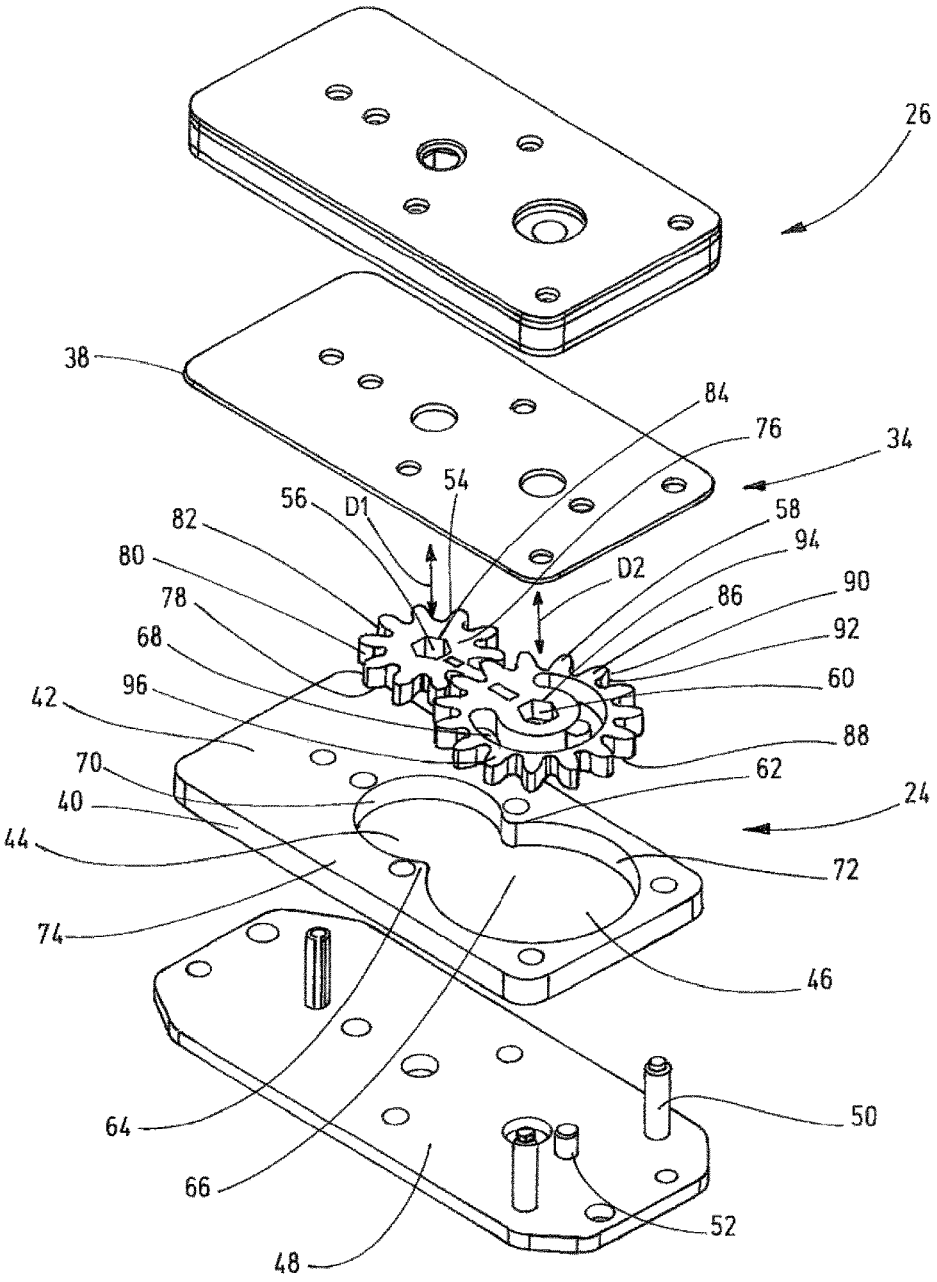
FIG. 2 is an exploded perspective of the gear mechanism and detent arrangement of the cross-type limit switch shown in FIG. 1.

FIG. 2 shows the operating unit consisting of the gear mechanism 24 and the detent arrangement 26. The gear mechanism 24 comprises a gear mechanism cover plate 38 that has circular openings for shafts, spring pins and screws. Arranged under the gear mechanism cover plate 38 there is arranged an intermediate plate 42 that is congruent relative to the gear mechanism cover plate 38 with respect to the outside border 40 of the gear mechanism cover plate 38, with the intermediate plate having a first cutout 44 and a second cutout 46. The first cutout 44 is smaller than the second cutout 46. The first cutout 44 and the second cutout 46 form a combined cutout that has an outside contour resembling a figure "8". The intermediate plate 42 also contains circular openings that are congruent to the openings of the gear mechanism cover plate 38. Below the intermediate plate 42 there is arranged a gear mechanism base plate 48 that—like the gear mechanism cover plate 38 and the intermediate plate 42—has substantially a rectangular structure. Like the intermediate plate 42 and the gear mechanism cover plate 38, the gear mechanism base plate 48 has openings intended for spring pins 50. Arranged in the gear mechanism base plate 48 there is arranged a detent pin 52 that extends into the second cutout 46 of the intermediate plate 42. In the first cutout 44 there is arranged a first gearwheel 54 that has a central first plug-through opening 56. Arranged in the second cutout 46 there is a second gearwheel 58 that has a central second plug-through opening 60. The first gearwheel 54 and the second gearwheel 58 are arranged in one plane. The first plug-through opening 56 and the second plug-through opening 60 define passage directions D1 and D2 that extend parallel with respect to each other. The first gearwheel 54 is smaller than the second gearwheel 58. Both gearwheels 54, 58 are arranged in the first cutout 44 and in the second cutout 46 in such a manner that the gearwheels 54, 58 mesh. The first cutout 44 and the second cutout 46 form a passage opening 66 through the intermediate plate 42. Due to the form of the combined first cutout 44 and second cutout 46, a first projection 62 and a second projection 64 extend into the passage opening 66. In doing so, the first cutout 44 encloses the first gearwheel 54 just as the second cutout 46 encloses the second gearwheel 58. The first cutout 44 forms a pocket for the first gearwheel 54, just as the second cutout 46 forms a pocket for the second gearwheel 58.

The second gearwheel 58 has an arcuate oblong hole 68 into which engages the detent pin 52. As a result of this arrangement, the second gearwheel 58 cannot turn beyond a certain angle. In addition, this specifies a reference position of the actuating lever 18, which position potentially being disposed for verifying the setting of the limit switch 10. Overall, this arrangement thus ensures a safe limit stop. The gear mechanism base plate 48, the gear mechanism cover plate 38 and the intermediate plate 42 are preferably made of plate-shaped base material.

The gear mechanism base plate 48, the gear mechanism cover plate 38 and the intermediate plate 42 are manufactured, for example, by laser cutting or water jet cutting with cuts that are only perpendicular with respect to a plane 74 defining the plate. It is also possible to use a standard plate material that already displays the desired thickness. Using the intermediate plate 42 as an example, the first cutout 44 has a first wall 70 and the second cutout 46 has a second wall 72, each being transverse to the plate plane 74.

The first gearwheel 54 has a planar upper side 76 and a planar underside 78 and a first circumferential surface 80 that consists of wall sections 82 extending perpendicular to the planar upper side 76 and the planar underside 78. The first plug-through opening 56 is a hexagonal socket with walls that are parallel to the planar upper side 76. A corresponding hexagonal section of the shaft 20 is arranged in the first plug-through opening 56 so that the shaft 20 and the first gearwheel 54 are non-rotatably coupled one to another. The first gearwheel 54 is manufactured by cuts perpendicular to the plane of the plate-shaped base material of the first gearwheel 54, for example produced by laser cutting or water jet cutting. Preferably, the first gearwheel 54 is manufactured only by cuts vertical to the plate plane 74.

The second gearwheel 58 is plate-shaped flat with a planar upper side 86 and a planar underside 88 and has a second circumferential surface 90 that consists of wall sections 92 extending parallel to the axis of rotation. The second plug-through opening 60 is also a hexagonal socket with walls that a parallel to the upper side 86 and the underside 88. A corresponding hexagonal section of the switch shaft 138 is arranged in the second plug-through opening 60, so that the second gearwheel 58 is non-rotatably coupled with the switch shaft 138. Also, the second gearwheel 58 is thus manufactured by cuts perpendicular to the plane of the plate-shaped base material of the second gearwheel 58, for example by laser cutting or water jet cutting. Preferably, the second gearwheel 58 is manufactured with cuts vertical to the plate plane 96.

Figure 3:
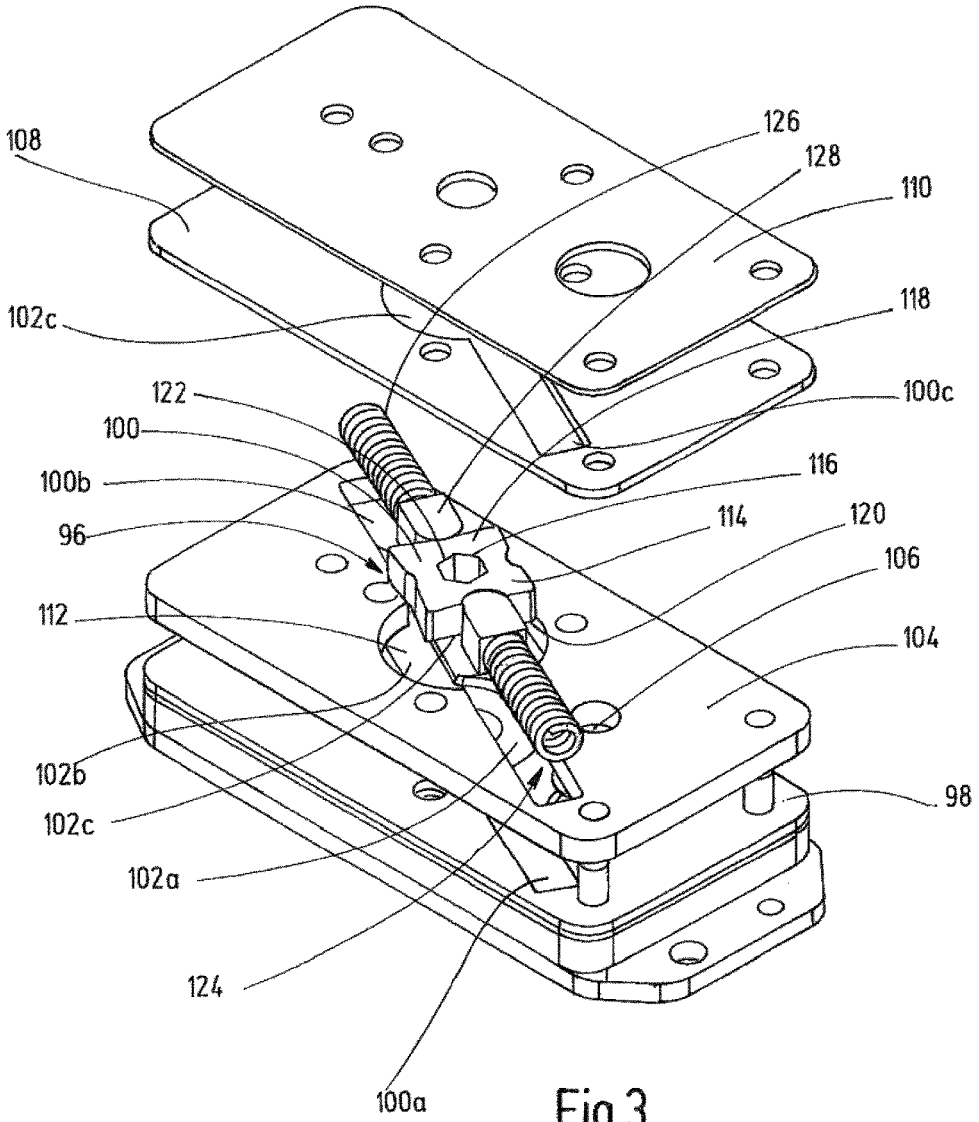
FIG. 3 is a further exploded perspective of the gear mechanism and detent arrangement.

FIG. 3 shows another view of the package or stack comprising the gear mechanism 24 and the detent arrangement 26. The detent arrangement 26 comprises a detent arrangement base plate 98 that has an oblong cutout 100*a* extending diagonally with respect to the longitudinal direction of the detent arrangement base plate 98. Provided in the center of the first oblong cutout 100*a*, there is a circular first round cutout 102*a*. The detent arrangement 26 comprises a first detent arrangement intermediate plate 104 that is arranged on the detent arrangement base plate 98 and has a second oblong cutout 100*b*. Provided in the center of the second oblong cutout 100*b*, there is a circular second round cutout 102*b*. The first detent arrangement intermediate plate 104 has a first bearing opening 106. The detent arrangement 26 comprises a second detent arrangement intermediate plate 108 that is arranged on the first detent arrangement intermediate plate 104 and has a third oblong cutout 100*c*. A circular third round cutout 102*c* is arranged in the center of the third oblong cutout 100*c*. Finally, the detent arrangement 26 comprises a detent arrangement cover plate 110 that is arranged on the second detent arrangement intermediate plate 108. The detent arrangement base plate 98, the detent arrangement intermediate plates 104 and 108 and the detent arrangement cover plate 110 are thus held together with the aid of the spring pins 50 in such a manner that the detent arrangement base plate 98, the detent arrangement intermediate plates 104 and 108 and the detent arrangement cover plate 110 are stacked in a congruent manner. As a result of this, there is a congruence of the oblong cutouts 100 *a-c* and also a congruence of the circular cutouts 102 *a-c*.

Due to the round cutouts 102 *a-c*, a pocket 112 is formed for a star wheel 114 that is arranged in the pocket 112. The star wheel 114 has a central star wheel plug-through opening 116 that is disposed for the accommodation of a shaft 20. The star wheel 114 has a planar upper side 118 and a planar underside 120.

The oblong cutouts 100 *a-c*, together, form a space that is disposed for the accommodation of two spring catches 124. One spring catch 124 has a spring 126 that forces a detent block 128 into engagement with the star wheel 114 in order to engage the position of the actuating lever 18 in a specific position. The detent arrangement 26 may be made up of two or more detent arrangement intermediate plates 104, 108 in order to be able to use standard sheet metal, i.e., metal sheets having standard thicknesses, and to be able to use, at the same time, standard springs.

The plate-shaped elements such as, e.g., the gear mechanism cover plate 38, the gear mechanism base plate 48, the intermediate plate 42 as well as the detent arrangement base plate 98, the first detent arrangement intermediate plate 104, the second detent arrangement intermediate plate 108 and the detent arrangement cover plate 110 are preferably laser-cut along cutting lines extending perpendicularly to the respective planar upper sides and undersides.

Figure 4:
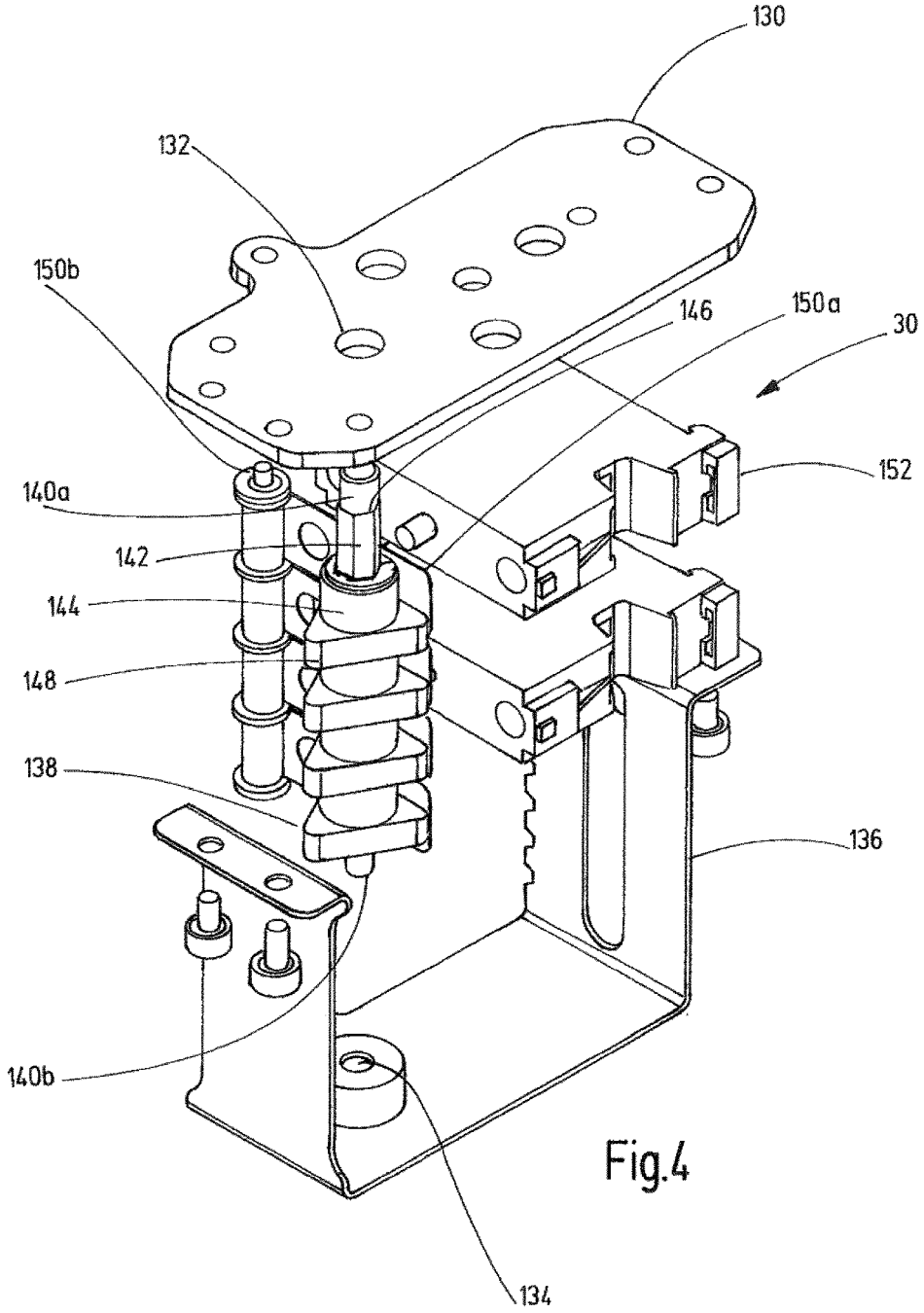
FIG. 4 is an exploded perspective of a switch element array of the cross-type limit switch shown in FIG. 1.

FIG. 4 shows an exploded view of the switch element assembly 30. The switch element assembly 30 comprises a holding plate 130 that has approximately the same shape as the gear mechanism base plate 48. The holding plate 130 has a first switch shaft opening 132. A second bearing opening 134 is provided in a holding bracket 136 that is fastened to the holding plate 130. The switch shaft 138 has a first round section 140*a*, a cylindrical section 140*b*, an outside hexagonal section 142, a switch section 144 and a second round section 140*b*. On an axial transition 146 from the cylindrical section 140 to the outside hexagonal section 142, there may be a bezel or rounding. The first round section 140 and the outside hexagonal section 142 of the switch shaft 138 are passed through the switch shaft opening 132 and supported by the second round section 146 in the second bearing opening 134 in the holding bracket 136. Four triangular actuating cams 148 are arranged on the switch section 144. Different from the way shown in FIG. 4, the actuating cam 148 also may be arranged offset relative to each other in increments of 60° on the switch shaft 138. Adjacent to the switch shaft 138 there are arranged four spring steel sheets 150*a* on a spring steel shaft 150*b*, each of these being associated with respectively one actuating cam or trip cam 148. The four spring sheets 150*a* are arranged in such a manner that they each can be brought into engagement with the switch elements 152 of the switch element assembly 30.

Figures 5, 5A:
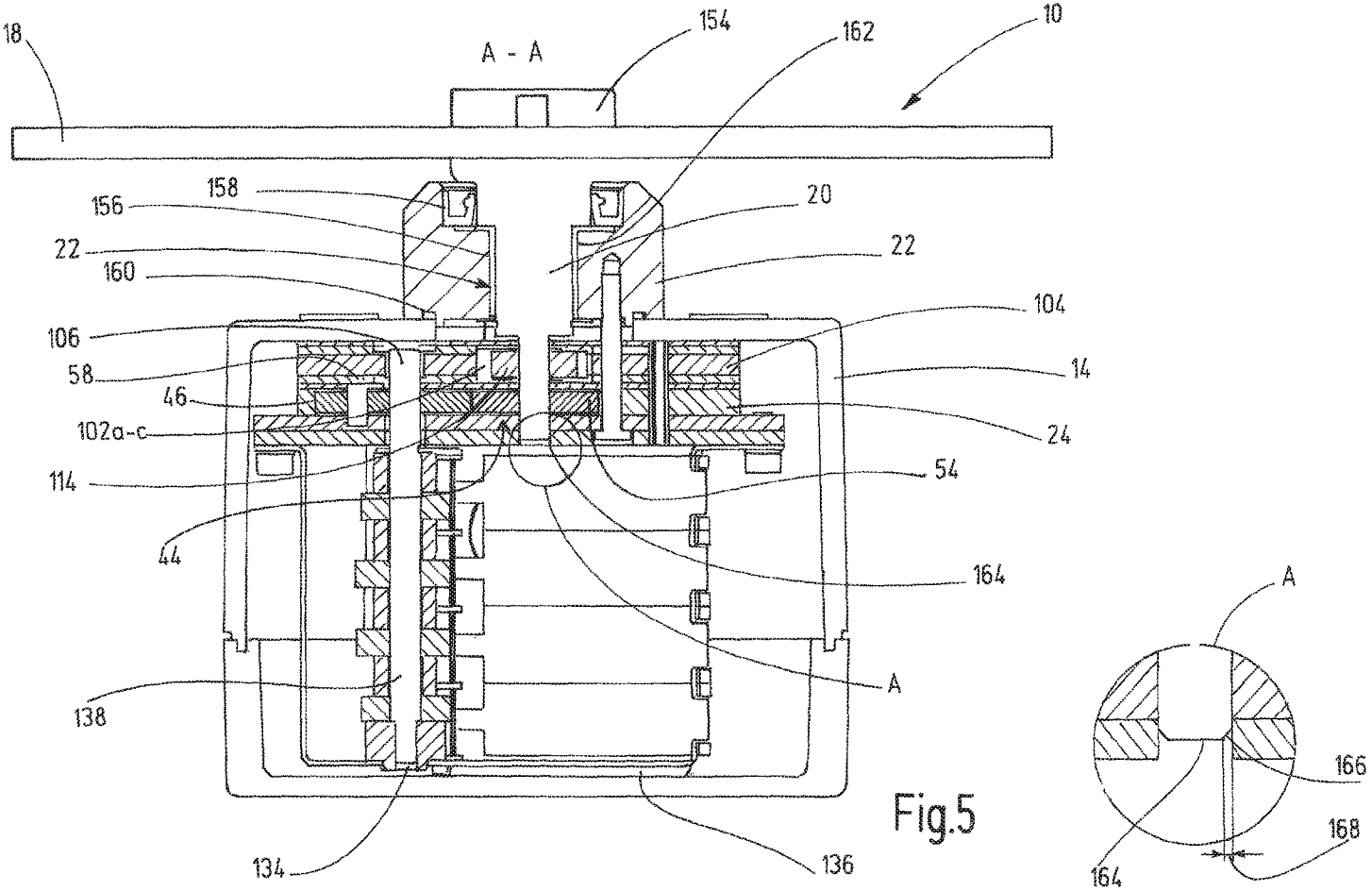
FIG. 5 is a vertical section of the cross-type limit switch shown in FIG. 1.
FIG. 5A is an exploded view of the encircled area in FIG. 5.

FIG. 5 shows a cross-section through the limit switch 10. The actuating lever 18 is fastened to a head part 154 of the shaft 20. The shaft 20 is radially and axially supported in a sliding bearing 156 arranged in the bearing arrangement 22. A sealing ring 158 arranged in the bearing housing 132 protects the sliding bearing 156 against dust and debris. The bearing arrangement 22 is sealed by a sealing ring 160 relative to the housing upper part 14.

The sliding bearing 156 displays a certain radial bearing play that is defined by the difference of half the inside diameter of the bearing opening 162 and half the outside diameter of the shaft 20. The first gearwheel 54 that is arranged on the shaft 20 is arranged in the first cutout 44 with play, in which case this refers to the radial distance of the first gearwheel 54 from the first cutout 44. Preferably, the first gearwheel 54 is still arranged flush in the first cutout 44 so that the first cutout 44 centers the first gearwheel 54 at least to such an extent that the insertion of the shaft 20 in the gear mechanism 34 is possible without additional centering means. The shaft 20 may have a bezel 166 at its shaft end face 164 (see partial view in FIG. 5). Preferably, the play of the first gearwheel 54 in the first cutout 44 is less than the dimensions 168 of the bezel.

The star wheel 114 is also arranged with play in the round cutouts 102 *a-c*. Preferably, the radial bearing play of the sliding bearing 156 is less than the play of the star wheel 114 in the round cutouts 102 *a-c*.

The switch shaft 138 is arranged in a bearing in the first detent arrangement intermediate plate 104 provided in the first bearing opening 106. A second bearing point is formed by the second bearing opening 134 that is arranged in the holding bracket 136. Overall, the bearing in the first bearing opening 106 and the second bearing opening 134 forms a second bearing arrangement. The second bearing arrangement displays radial play. The second gearwheel 58 has a certain play in the second cutout 46. Preferably, the radial play of the switch shaft bearing is less than the play of the second gearwheel 58 in the second cutout 46. Preferably, the second gearwheel 58 is nevertheless arranged flush in the second cutout 46 so that the second cutout 46 centers the first gearwheel 54 at least to such an extent that the insertion of the shaft 20 in the gear mechanism 24 is possible without additional centering means. The switch shaft 138 can have a bezel on its shaft end face. Preferably, the play of the second gearwheel 58 in the first cutout 44 is less than the dimensions of the bezel (analogous to partial view A).

Figure 6:
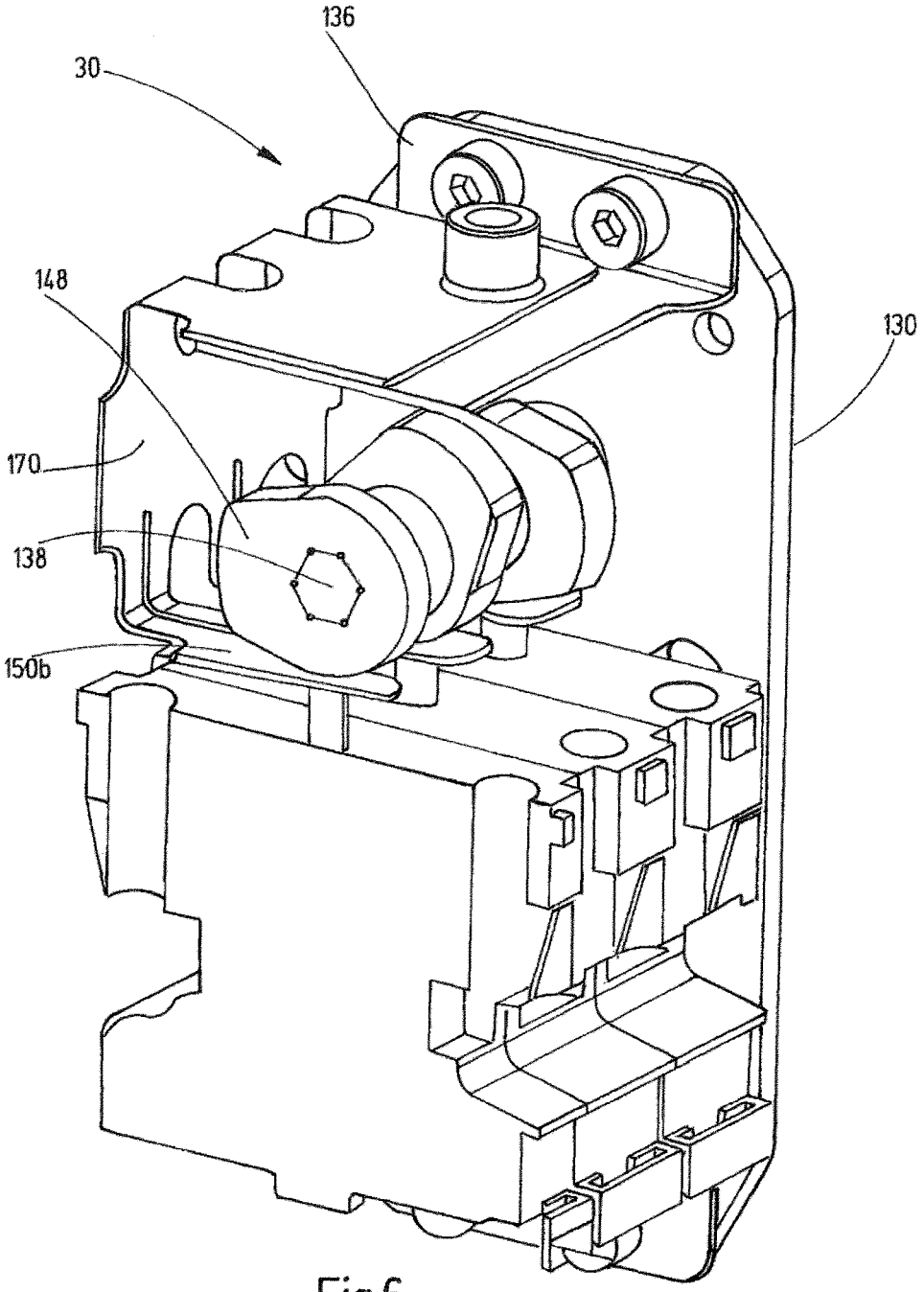
FIG. 6 is a perspective of another embodiment of a cross-type limit switch according to the invention.

FIG. 6 shows a sectional view of another embodiment of a switch element assembly 30. The switch element assembly 30 also comprises a holding plate 130 that may have the same construction as the holding plate 130 of the embodiment of FIG. 4. Different from the embodiment in FIG. 4, in this case there is no spring steel shaft 150*a* but the spring steel sheets 150*b* are the sections of a bent sheet metal part 170 that is fastened to the holding bracket 136. The actuating cams 148 are eccentrically offset relative to the switch shaft 138, i.e., by 60° or a multiple thereof.

From the foregoing, it can be seen that a cross-type limit switch 10 is provided that has a housing 12 in which a gear mechanism 24 is arranged, which gear mechanism has a gear mechanism cover plate 38, a gear mechanism base plate 48 and at least one intermediate plate 42 arranged between the gear mechanism cover plate 38 and the gear mechanism base plate 48. The intermediate plate 42 has at least one first cutout 44 in which a first gearwheel 54 is arranged. The intermediate plate 42 also has at least one second cutout 46 in which a second gearwheel 58 is arranged. The first gearwheel 54 has a first plug-through opening 56 and the second gearwheel 58 has a second plug-through opening 60. A shaft 20 bears an actuating lever 18 arranged outside the housing 12 and is mounted rotatably in a first bearing arrangement 22 connected to the housing 12. The shaft 20 extends through the first plug-through opening 56 in order to couple in rotationally fixed fashion to the first gearwheel 54 and to mount said gearwheel radially. The cross-type limit switch 10 also has a rotary switch 30, which is arranged in the housing 12 and has a switch shaft 138, which is mounted rotatably in a second bearing arrangement 106, 34 and extends through the second plug-through opening 60 in order to couple in rotationally fixed fashion to the second gearwheel 58 and to mount said gearwheel radially.

LIST OF REFERENCE SIGNS

| | |
|---|---|
| 10 | Cross-type limit switch |
| 12 | Housing |
| 14 | Housing upper part |
| 16 | Housing lower part |
| 18 | Actuating lever |
| 20 | Shaft |
| 22 | First bearing arrangement |
| 24 | Gear mechanism |
| 26 | Detent arrangement |
| 28 | Screws |
| 30 | Rotary switch |
| 32 | Screws |
| 34 | Passage |
| 36 | Inside of the housing |
| 38 | Gear mechanism cover plate |
| 40 | Border |
| 42 | Intermediate plate |
| 44 | First cutout |
| 46 | Second cutout |
| 48 | Gear mechanism base plate |
| 50 | Spring pins |
| 52 | Detent pins |
| 54 | First gearwheel |
| 56 | First plug-through opening |
| 58 | Second gearwheel |
| 60 | Second plug-through opening |
| 62 | First projection |
| 64 | Second projection |
| 66 | Passage opening |
| 68 | Oblong hole |
| 70 | First wall |
| 72 | Second wall |
| 74 | Plate plane |

-continued

| | |
|---|---|
| 76 | Upper side |
| 78 | Underside |
| 80 | First outside circumferential surface |
| 82 | Wall sections of the first gearwheel |
| 86 | Upper side |
| 88 | Underside |
| 90 | Second outside circumferential surface |
| 92 | Wall sections |
| 96 | Plate plane |
| 98 | Detent arrangement base plate |
| 100a-c | Oblong cutouts |
| 102a-c | Round cutouts |
| 104 | First detent arrangement intermediate plate |
| 106 | Bearing opening |
| 108 | Second detent arrangement intermediate plate |
| 110 | Detent arrangement cover plate |
| 112 | Pocket |
| 114 | Star wheel |
| 116 | Star wheel plug-through opening |
| 118 | Upper side of star wheel |
| 120 | Underside of star wheel |
| 124 | Spring catch |
| 126 | Spring |
| 128 | Detent block |
| 130 | Holding plate |
| 132 | Switch shaft opening |
| 134 | Second bearing opening |
| 136 | Holding bracket |
| 138 | Switch shaft |
| 140 a, b | First, second round section(s) |
| 142 | Outside hexagonal section |
| 144 | Switch section |
| 146 | Transition |
| 148 | Actuating cam |
| 150 a, b | Spring steel shaft, spring steel sheet(s) |
| 152 | Switch element |
| 154 | Head part |
| 156 | Sliding bearing |
| 158 | Sealing ring |
| 160 | Sealing ring |
| 162 | Bearing opening |
| 164 | Shaft end face |
| 166 | Bezel |
| 168 | Dimensions of bezel |
| 170 | Sheet metal part |

The invention claimed is:

1. An explosion-proof limit switch (10) comprising:

a housing (12);

a gear mechanism (24) arranged in said housing (12), said gear mechanism including a gear mechanism cover plate (38), a gear mechanism base plate (48) and at least one intermediate plate (42) arranged between the gear mechanism cover plate (38) and the gear mechanism base plate (48);

said intermediate plate (42) having at least one cutout (44) in which a first gearwheel (54) is arranged and at least one second cutout (46) in which a second gearwheel (58) is arranged;

said first gearwheel (54) having a first plug-through opening (56) and said second gearwheel (58) having a second plug-through opening (60);

a shaft (20) having an actuating lever (18) arranged outside the housing (12) and being rotatably supported in a first bearing arrangement (22) connected to the housing (12) and extending through the first plug-through opening (56) of the first gearwheel (54) in order to couple with the first gearwheel (54) in a torque transmitting manner and to radially support said first gearwheel (54); and a rotary switch (30) arranged in the housing (12) and having a switch shaft (138) that is rotatably supported in a second bearing arrangement (106, 134) and extends through the second plug-through opening (60) of the second gearwheel (58) in order to couple with the second gearwheel (58) in a torque transmitting manner and to radially support said second gearwheel (58).

2. The explosion-proof limit switch (10) of claim 1 in which said first gearwheel (54) and said second gearwheel (58) are arranged with play in the respective first and second cutouts (44, 46).

3. The explosion-proof limit switch (10) of claim 2 in which the play between said first and second gearwheels (54, 58) and the respective first and second cutouts (44, 46) is greater than any radial bearing play of the shaft (20) of the actuating lever (14) or the switch shaft (138) of the rotary switch (30).

4. The explosion-proof limit switch (10) of claim 2 in which said shaft (20) of the actuating lever (18) has an end face formed with a bezel (166) or rounding, and the play of the first and second gearwheels (54, 58) and the respective first and second cutouts (44, 46) is smaller than the bezel (166) or rounding of the shaft end face (164).

5. The explosion-proof limit switch (10) of claim 1 in which said first cutout (44) encloses said first gearwheel (54) and said second cutout (46) encloses said second gearwheel (58).

6. The explosion-proof limit switch (10) of claim 1 in which said first cutout (44) and said second cutout (46) form passage openings (44) with walls (70, 72) that are parallel to an axis of rotation of the respective gearwheel (54, 58).

7. The explosion-proof limit switch (10) of claim 1 in which said gear mechanism cover plate (38), gear mechanism base plate (48) and intermediate plate (42) each are planar elements.

8. The explosion-proof limit switch (10) of claim 1 in which said gear mechanism base plate (48) and/or the gear mechanism cover plate (38) and/or the intermediate plate (42) and/or a gearwheel (54, 58) are laser-cut.

9. The explosion-proof limit switch (10) of claim 1 in which said first gearwheel (54) and said second gearwheel (58) each have a planar upper side (76) and a planar underside (78) with all cuts through the planar sides extending transversely to the upper side (76) and underside (78).

10. The explosion-proof limit switch (10) of claim 1 in which said first gearwheel (54) meshes with said second gearwheel (58).

11. The explosion-proof limit switch (10) of claim 1 in which said gear mechanism (24) has only two gears which comprise said first gearwheel (54) and said second gearwheel (58).

12. The explosion-proof limit switch (10) of claim 1 in which said first gearwheel (54) and said second gearwheel (58) are arranged in one plane.

13. The explosion-proof limit switch (10) of claim 1 in which said shaft (20) of said actuating lever (18) is coupled with a detent arrangement (26) having a detent arrangement base plate (98), a detent arrangement cover plate (11) and at least one detent arrangement intermediate plate (104, 108) with a pocket (112), a star wheel (114) having a star wheel plug-through opening (116) arranged in the pocket (112), and said shaft (20) of said actuating lever (18) extending through the star wheel plug-through opening (116).

14. The explosion-proof limit switch (10) of claim 1 in which said switch shaft (138) of the rotary switch (30) is a cam shaft that is engageable with a series of switch elements (152) arranged in the housing (12).

* * * * *